United States Patent [19]

Helms

[11] 4,072,231

[45] Feb. 7, 1978

[54] CORNER PROTECTOR

[76] Inventor: Hosea W. Helms, 7451 Richmond Place, St. Louis, Mo. 63143

[21] Appl. No.: 769,514

[22] Filed: Feb. 17, 1977

[51] Int. Cl.[2] ..... B65D 85/48

[52] U.S. Cl. ..... 206/453; 206/586; 229/14 C; 229/DIG. 1; 248/345.1; 248/206 R; 217/53

[58] Field of Search ..... 206/586, 453; 229/14 C, 229/DIG. 1; 217/52, 53; 248/345.1, 206

[56] References Cited

U.S. PATENT DOCUMENTS

| | | | |
|---|---|---|---|
| 3,041,775 | 7/1962 | Brown, Jr. et al. | 206/586 X |
| 3,049,260 | 8/1962 | Stone | 206/586 X |
| 3,725,188 | 4/1973 | Kalt | 206/453 X |

*Primary Examiner*—George T. Hall

*Attorney, Agent, or Firm*—Lionel L. Lucchesi

[57] ABSTRACT

A molded corner protector which is attached to a second structure includes an enclosure having a pie shaped top surface and a pair of curved side walls extending downwardly from the top surface. The enclosure is spaced from the second structure along an air pocket defined by the enclosure. The protector preferably is constructed from a relatively soft, pliable rubber like plastic substance and is designed so that the enclosure meets the second structure along the outboard edges of the enclosure. Means for attaching the protector to the second structure preferably include both double sided foam tape attached to at least one lip formed within the air pocket, and a suction cup integrally formed with the top surface of the protector enclosure on the air pocket side thereof.

14 Claims, 6 Drawing Figures

CORNER PROTECTOR

BACKGROUND OF THE INVENTION

This invention relates to resilient cushioning corner protectors and more particular, to corner protectors adapted for use with second structures for protecting either the structure from damage during shipping or for protecting children and adults against injury occasioned by contact with the corners of the structure.

The prior art reveals a number of corner protectors intended both to protector furniture, for example, during shipment, or to protect children and adults against injuries occasioned by accidental contact with the corners of various structures found in the home. While these prior art devices work for their intended purposes, their designs have been deficient from at least two aspects. First, if they offer large areas of cushion protection, in the way of an air pocket between the structure and the protector, they are inefficiently attached to the structure and may come loose during use. Second, where adequate attachment provisions are provided in the protector design, the air cushion effect of the design is severely handicapped.

My invention overcomes these prior art handicaps by providing a protector structure which provides a large air pocket area between the protector and the structure with which it is used. The air pocket extends along the top surface, the side surfaces and edges defined by those surfaces of the second structure. Attachment is provided within the air pocket in a manner that minimizes the reduction of air pocket protection, yet ensures satisfactory attachment over the life of the protector.

One of the objects of this invention is to provide a simple, inexpensive, one piece corner protector adapted for installation on exposed corners of a second structure to protect against injury caused by contact with those corners.

Another object of this invention is to provide a corner protector readily mountable over exposed corners and areas of a second structure without risk of defacing or damaging the second structure.

Another object of this invention is to provide a corner protector which is removably mounted to a second structure, removal of the protector being accomplished easily when the protector is no longer required.

Another object of this invention is to provide a corner protector utilizing broad air pocket coverage along the exposed corner of a second structure to increase the resiliency and cushioning effect of the protector.

Other objects of this invention will be apparent to those skilled in the art in light of the foregoing description and accompanying drawings.

SUMMARY OF THE INVENTION

In accordance with this invention, generally stated, a corner protector is provided with a large area air pocket between the protector enclosure and a second structure. The enclosure has a top surface meeting the second structure along an arcuate edge. The top surface has a rounded portion between the generally flat top surface and the arcuate edge thereof. A first side wall and a second side wall are integrally formed with the top surface and extend downwardly from that surface. The side walls are formed with a predetermined radius of curvature so that a continuous air pocket is defined by the protector in its intermounted position with a second structure. The edges of the protector meeting the structure are arranged to close the air pocket upon positioning of the corner protector. Means also are provided within the air pocket for removably mounting the protector to the second structure.

DESCRIPTION OF THE PREFERRED EMBODIMENT

Figure 1:
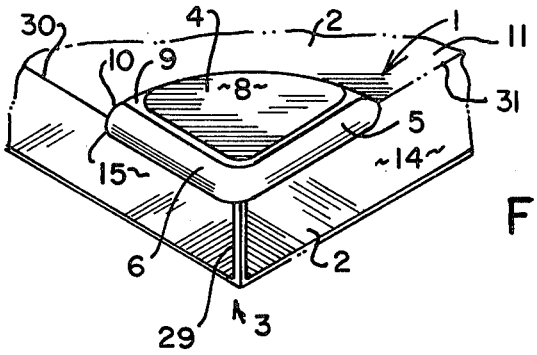
FIG. 1 is a view in perspective of one illustrative embodiment of corner protector of this invention.
Figure 2:
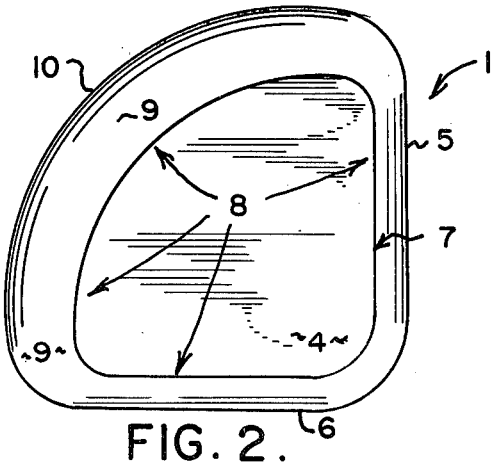
FIG. 2 is a top plan view of the protector shown in FIG. 1.
Figure 3:
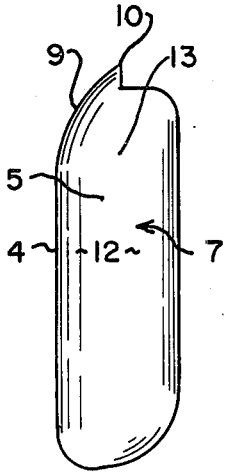
FIG. 3 is a view in side elevation of the protector shown in FIG. 1.
Figure 4:
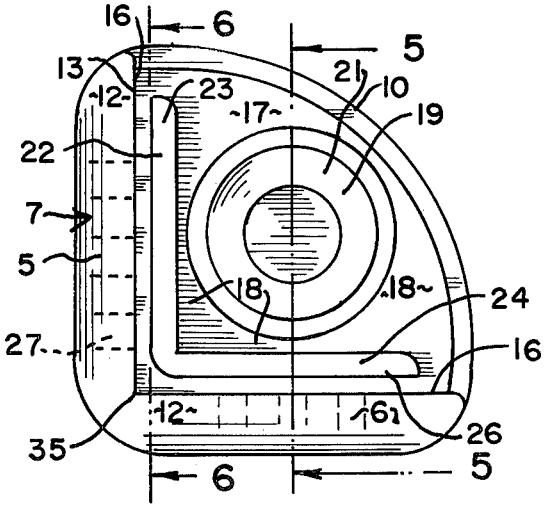
FIG. 4 is a bottom plan view of the protector shown in FIG. 1.
Figure 5:
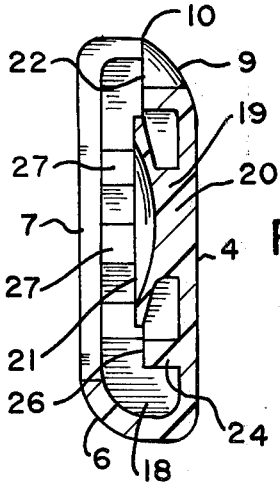
FIG. 5 is a sectional view, taken along the line 5—5 of FIG. 4.
Figure 6:
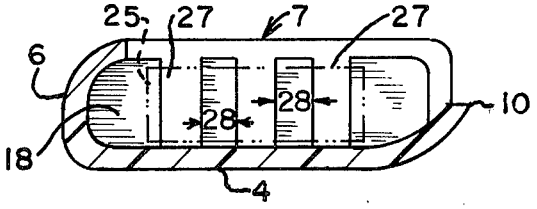
FIG. 6 is a sectional view, taken along the line 6—6 of FIG. 4.

Referring now to the drawings, reference numeral 1 indicates one illustrative embodiment of corner protector of this invention. The corner protector 1 is intended for use with a second structure 2 having a corner 3 which generally is a potential hazard, as for example, when accidental contact is made with the corner by adults or children. The structure 2 commonly is a piece of furniture found in the home. Thus, it might be a table or the like, although the structure obviously is not limited to furniture, the protector 1 being useful with a variety of structures having corners requiring protection for one reason or another. The structure 2 includes sides 14 and 15 and a top 11 which meet at a corner edge 29 and respective top-side edges 30 and 31.

The protector 1 includes a top surface 4, a first side wall 5, and a second side wall 6 arranged to define an enclosure 7. The top surface 4 has a relatively large generally flat area 8 and a curved part 9 which terminates in an arcuate lip 10. The curved part 9 enables the top surface 4 to be spaced from the top 11 of the structure 2 in the intermounted position of the protector 1. This spacing is important, as later described in greater detail. Overall, the particular structural arrangement chosen for the enclosure 7 of the embodiment illustrated gives the protector 1 a wedge or pyramidal shape in plan, the arcuate lip 10 modifying the plan view of the top surface 4 from a true pyramidal surface.

The side walls 5 and 6 are identical and generally include a curved surface 12 which extends outwardly of the top surface 4 along the edge of the area 8, and inwardly of the top surface 4 along a lower extremity 13 of the sides 5 and 6. The curvature of the sides 5 and 6 enables the sides 5 and 6 to be spaced from the sides 14 and 15 of the structure 2. An inner edge 16 along the lower extremity 13 of the sides 5 and 6 defines an abutment surface which engages the sides 14 and 15 of the structure 2 in the mounted position of the protector 1. When so intermounted, the space between the top 11 and sides 14 and 15 of the structure 2 and the enclosure 7 of the protector defines a closed air pocket 18 along a bottom or lower side 17 of the enclosure 7. Air pocket 18 extends along the entire lower side 17 of the enclosure 7, including the area delimited by the top surface 4 and the side walls 5 and 6. As later described however, various attachment means do remove portions of the air pocket 18 from actual air pocket use. Nevertheless, the provision for the air pocket 18 greatly increases the cushion effect provided by the protector 1, even though the corner protector 1 is originally constructed from a flexible, rubber like substance.

The corner protector 1 is mounted to the structure 2, in the embodiment illustrated, in two distinct ways. First, a suction cup 19 is integrally formed with the top surface 4 along the bottom 17 thereof. Suction cup 19 is conventional and includes a base portion 20 and a cup 21 which forms a conventional air interlock with the top 11 of the structure 2 when the protector 1 is placed in position.

The second attachment method used in conjunction with the protector 1 makes use of conventional double sided foam tape. Toward that end, an L-shaped lip 22 having a first leg 23 and a second leg 24 is integrally formed with the top 4 along the bottom side 17 during protector 1 manufacture. The lip 22 extends for approximately the length of the respective side walls 5 and 6. Lip 22 has a flat upper side 26 which serves as a base to receive a strip of conventional double sided foam tape, not shown. In some applications, use of one of the suction cups 19 or foam tape along the lip 22 may be eliminated, if desired.

A plurality of ribs 27 extend between the lower side 17 of the top 4 and the edge 16 of the sides 5 and 6. The ribs 27 are spaced from one another along a distance 28. The ribs 27, like the lip 22, delimit a base for attaching a strip of double sided foam tape 25, shown in phantom lines, within the air pocket 18 of the corner protector 1. The tape 25 ensures attachment of the sides 5 and 6 to the structure 2, completely sealing the air pocket 18 along the edges 10 and 16 of the protector 1.

Use of the corner protector 1 is relatively simple. The protector 1 is provided in the form shown with a plurality of strips of double sided foam tape which are attached to the lip 22 and the ribs 27 either as manufactured or prior to the attachment of the protector 1 to the structure 2. The protector 1 is maneuvered until the corner edge 29 of the structure 2 is engaged by a corner point 35 of the enclosure 7. The corner point 35 is defined by the intersection of the sides 5 and 6 along the edge 16 of those two sides. Thereafter, the suction cup 21 is engaged with the top 11. These operations automatically will attach the double sided foam tape along both the sides 14 and 15 of the structure 2, and along the top 11 thereof. Once placed in position, the protector 1 offers relative safety from harm due to accidental engagement with the corner of the structure 2. Removal of the protector 1 is accomplished merely by disengaging the cup 21 and the foam tape from the structure 2. Corner protector 1, of course, is reuseable, if desired, although additional tape may be necessary to reachieve proper engagement between the enclosure 7 and structure 2.

Numerous variations, within the scope of the appended claims, will be apparent to those skilled in the art in light of the foregoing description and accompanying drawings. Thus, the overall design silhouette may be altered in other embodiments of this invention, provided that the design silhouette changes do not effect air pocket 18 operation. Likewise, various thicknesses and sizes of material may be substituted for those shown and described. Although both foam tape and suction cup adhesion were described, those skilled in the art will recognize that one of the types of adhesion described may be eliminated, if desired. Likewise, other adhesion forms may be employed, if desired. The size of the suction cup 19, and in particular, the cup 21 part thereof, may be changed. These variations are merely illustrative.

Having thus described the invention, what is claimed and desired to be secured by Letters Patent is:

1. A corner protector which is applied to the corners of a second structure, comprising:

an enclosure including a relatively flat top surface area, and a curved portion terminating in an arcuate edge, a first curved side wall, and a second curved side wall, said first and second side walls extending downwardly from said top surface area and terminating in an edge, each edge of said side walls abutting said second structure in the intermounted position of said protector, said enclosure defining an air pocket with said second structure;

a suction cup mounted to a bottom side of said top surface area in said air pocket;

an L-shaped lip outboard of said suction cup in said air pocket;

at least one vertical lip extending along the height dimension of each of said side walls; and double edge adhesive means applied to said L-shaped lip and to each of said vertical lips for ensuring attachment of said corner protector to said second structure.

2. The corner protector of claim 1 wherein said protector is a unitary structure constructed from a pliable, rubber like substance.

3. The corner protector of claim 2 wherein said vertical ribs are integrally formed with each of said side walls.

4. The improvement of claim 3 wherein said suction cup is integrally formed with said enclosure.

5. A corner protector which is applied to the corners of a second structure, comprising:

an enclosure including a relatively flat top surface area, and a curved portion terminating in an arcuate edge, a first curved side wall, and a second curved side wall, said first and second side walls extending downwardly from said top surface area and terminating in an edge, each edge of said side walls abutting said second structure in the intermounted position of said protector, said enclosure defining an air pocket with said second structure;

an L-shaped lip in said air pocket;

at least one vertical lip extending along the height dimension of each of said side walls; and double edge adhesive means applied to said L-shaped lip and to each of said vertical lips for ensuring attachment of said corner protector to said second structure.

6. A corner protector which is applied to the corners of a second structure, comprising:

an enclosure including a relatively flat top surface area and a curved portion terminating in an arcuate edge, a first curved side wall, and a second curved side wall, said first and second side walls extending downwardly from said top surface area and terminating in an edge, each edge of said side walls abutting said second structure in the intermounted position of said protector, said enclosure defining an air pocket with said second structure; and a suction cup mounted to a bottom side of said top surface area in said air pocket.

7. In a corner protector having a one piece body adapted to mate with a corner of a second structure, said corner protector including a top surface, a first side wall and a second side wall, the improvement comprising an air pocket between said second structure and said corner protector, said air pocket being defined by a sloping end wall along one edge of said top surface area so that said top surface area lies in a plane above the plane of a surface of said second structure, and said first and second side walls having a radius of curvature imparted to them between said top surface and a terminal edge of said side walls so that said side walls are spaced from said second structure except along the engagement area of said terminal edge, and means for attaching said corner protector to said second structure, said attaching means being mounted in said air pocket.

8. The improvement of claim 7 wherein said attaching means comprises an L-shaped lip spaced from but positioned near said curved side walls, said L-shaped lip extending substantially for the length of said side walls, and double sided foam tape means mounted to said L-shaped lip.

9. The improvement of claim 8 further including at least one vertical rib extending between a lower side of said top surface area and the terminal edge of said curved side wall, and double sided foam tape means mounted to said vertical rib.

10. The improvement of claim 7 wherein said attaching means comprises a suction cup mounted to said top wall along the air pocket side thereof.

11. The improvement of claim 10 wherein said invention further includes an L-shaped lip mounted along said top wall, on the air pocket side thereof, and extending substantially for the length of said side walls, said lip defining a base for attachment of an adhesive means.

12. The improvement of claim 11 further including at least one rib extending between the lower side of said top wall and each of said side walls, said rib defining a base for attachment of an adhesive means.

13. The improvement of claim 12 wherein said adhesive means is double sided foam tape.

14. The improvement of claim 13 wherein said L-shaped lip is integrally formed with said top wall.

* * * * *